United States Patent [19]

Weyer

[11] Patent Number: 4,545,289

[45] Date of Patent: Oct. 8, 1985

[54] ADJUSTABLE ROTARY ACTUATOR

[76] Inventor: Paul P. Weyer, 48811 28th Ave., Southeast, Enumclaw, Wash. 98022

[21] Appl. No.: 530,976

[22] Filed: Sep. 9, 1983

[51] Int. Cl.[4] ..... F01B 31/14

[52] U.S. Cl. ..... 92/13.6; 92/33; 251/288

[58] Field of Search ..... 92/13.6, 13.4, 13.41, 92/13.5, 31, 33; 74/99 A; 251/288

[56] References Cited

U.S. PATENT DOCUMENTS

| | | | |
|---|---|---|---|
| 2,556,979 | 6/1951 | Purcell | 92/13.6 |
| 3,094,254 | 6/1963 | Cullen et al. | 92/13.5 X |
| 3,146,681 | 9/1964 | Sheesley | 92/13.5 |
| 3,156,160 | 11/1964 | Meyer et al. | 92/13.6 |
| 3,160,077 | 12/1964 | Ribeiro | 92/13.5 |
| 3,162,098 | 12/1964 | Lindberg | 92/13.6 X |
| 4,169,405 | 10/1979 | Tsunemoto et al. | 92/13.6 |
| 4,313,367 | 2/1982 | Weyer | 92/33 |

*Primary Examiner*—William E. Tapolcai
*Attorney, Agent, or Firm*—Seed and Berry

[57] ABSTRACT

A fluid-powered rotary actuator for providing end-limited rotational drive to another device, having a splined output shaft rotatably supported within a body and a drive end coupled to the other device; a linear-to-rotary transmission providing relative rotational movement between the body and the shaft, the transmission including a piston for application of fluid pressure to first and second side thereof to produce linear movement of the piston in first and second opposed directions which movement is translated into rotational movement of the shaft; a threaded body end cap adjustable from an end of the body remote from the drive end to permit selective longitudinal positioning of the cap relative to said body, and having a stop surface for engaging the second side of the piston and limiting its travel in the first direction; and an elongated sleeve adjustable from the remote end and extending from outward of the cap at the remote end to beyond the piston, and having a stop shoulder for engaging the first side of the piston and limiting its travel in the second direction, the cap and sleeve providing limits to rotational movement of the shaft.

10 Claims, 2 Drawing Figures

ADJUSTABLE ROTARY ACTUATOR

DESCRIPTION

1. Technical Field

The present invention relates generally to valve actuators, and more particularly, to rotary valve actuators of the type in which linear movement of a piston produces rotary movement of an output shaft. The invention relates to such type of rotary actuators used to drive valves or other devices requiring the rotation of the output shaft to be restricted between precise preselected limits.

2. Background Art

Rotary helical actuators have been employed in the past and offer the advantages of high-torque output capabilities from a simple linear piston and cylinder drive arrangement. One such actuator is shown in U.S. Pat. No. 4,313,367. A shortcoming of such rotary helical actuators, however, is that when the rotary motion on the output shaft is used to rotate another device or shaft, such as a valve stem in a fluid control valve, there is provided no easily accessible means for limiting the amount of rotation of the shaft within precise preselected and adjustable limits. Limiting the rotation is critical to avoid the actuator driving the valve beyond its normal range of positions between fully open and fully closed, and in some valves, from turning the valve sufficiently to cause valve damage.

In an attempt to overcome this shortcoming, adjustable stop screws have been mounted to the output shaft of the actuator external of the actuator casing, and cooperating stop shoulders have been positioned to engage the screws as the shaft rotates, thereby limiting the rotational travel of the shaft in both rotational directions. While this adaption of conventional adjustable stops to a rotary actuator initially appeared satisfactory, it was soon proven that the amount of torque produced on the output shaft by the actuator was sometimes sufficient to blunt or break the adjustment screws and thereby cause overdrive of the valve being driven. Additionally, it was undesirable to have the stop screws exposed to the environment and so readily accessible for adjustment by unauthorized persons.

Actuators have been constructed with adjustable limits to the rotational travel of the output shaft which can handle the torque and other forces encountered with rotary actuators. The actuators have used a threaded end cap at each end of the actuator casing with an interiorly facing stop shoulder to limit the longitudinal travel of a piston sleeve which, in turn, limits the rotational travel of the shaft. While this approach functions adequately to limit the shaft's travel, it requires that both ends of the actuator casing be accessible for adjustment of the end caps. Consequently, the positioning of one end cap had to be accomplished with the actuator disconnected from the valve it was to drive so that the valve would not block access to the cap. As such, all adjustments to the end cap subsequent to the very first one required removal of the actuator from the valve being driven. Since achieving a proper setting of a rotational limit often involves two or more adjustments of the end caps, use of an actuator with two adjustable end caps is not satisfactory and can result in excessive time delays and expended effort.

It will therefore be appreciated that there has a been a significant need for a rotary actuator with precise preselected and adjustable end rotational limits on the rotational travel of the output shaft which are adjustable from one end of the actuator without disconnecting the actuator from the device it is driving. The actuator should provide positive and accurate control of the rotational travel of the shaft, and be operable with the normal forces which occur with rotary actuators. The rotational control also should be unaffected by the environment in which the actuator is operated, and not be easily adjustable by unauthorized persons. The present invention fulfills this need and further provides other related advantages.

DISCLOSURE OF INVENTION

The present invention resides in a fluid-powered rotary actuator for providing precise preselected and adjustable, end-limited rotational drive to another device, such as a valve. The actuator has an outer elongated body having ports for introducing pressurized fluid therein; an output shaft rotatably supported within the body and having at least one drive end adapted for coupling to the other device to provide rotational drive thereto, the shaft drive end being positioned toward a drive end of the body; a linear-to-rotary transmission means disposed within the body coaxial with the output shaft and operable to provide relative rotational movement between the body and the output shaft, the transmission means including a piston and means for applying fluid pressure to a first side of the piston to produce linear movement of the piston in a first direction, and for applying fluid pressure to an opposite second side of the piston to produce linear movement of the piston in an opposite second direction, and means for translating linear movement of the piston into rotational movement of the shaft relative to the body; a first adjustable stop means for limiting linear travel of the piston in the first direction to provide an end limit to rotational movement of the shaft in a first rotational direction, the first stop means being adjustable from an end of the body remote from the drive end; and a second adjustable stop means for limiting linear travel of the piston in the second direction to provide an end limit to rotational movement of the shaft in a second rotational direction, the second stop means being adjustable from the same end of the body as the first stop means.

More specifically, in the presently preferred embodiment of the invention, the first stop means includes a threaded end cap disposed within the body at the remote end and cooperating with corresponding threads of the body to permit selective longitudinal positioning of the end cap relative to the body, the end cap having a stop surface for engaging the second side of the piston as it travels in the first direction. The second stop means includes an elongated stop member, the stop member extending from the remote body end and beyond the piston and having a stop positioned on the first side of the piston for engaging the first side of the piston as it travels in the second direction. The stop member has means for selective longitudinal positioning of the stop relative to the piston from the remote end. The stop member is an elongated stop sleeve positioned about the shaft for rotational movement therewith and extending from the remote body end and beyond the piston. The stop is a stop shoulder, and the positioning means includes threads positioned on the stop sleeve for cooperation with corresponding threads of the shaft to permit selective longitudinal positioning of the stop shoulder relative to the shaft and the piston by rotation of the stop sleeve from the remote end. The positioning means further includes a portion of the stop sleeve accessible from the remote end which is engageable with a tool for rotation of the stop sleeve. Locking means are provided for selectively and releasably locking the end cap to the body, and the stop sleeve to the shaft.

Other features and advantages of the invention will become apparent from the following detailed description, taken in conjunction with the accompanying drawings.

BEST MODE FOR CARRYING OUT THE INVENTION

Figure 2:
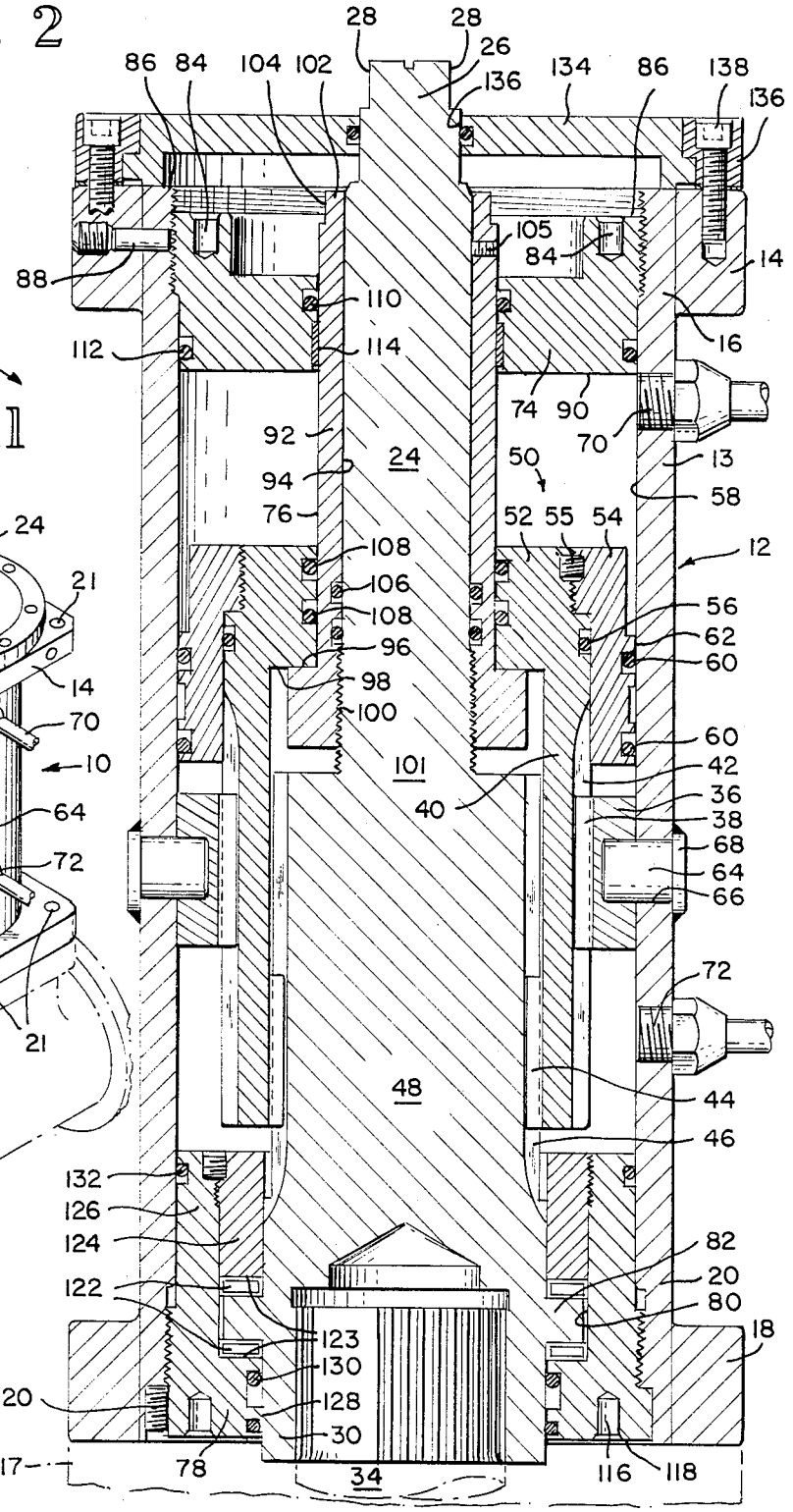
FIG. 2 is an enlarged sectional view of the helical rotary actuator shown in FIG. 1.
Figure 1:
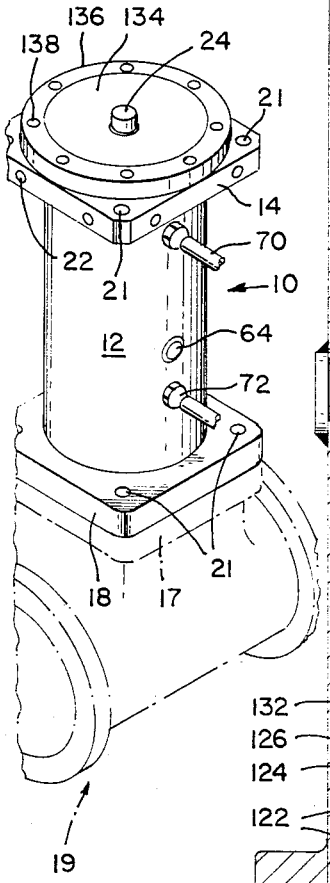
FIG. 1 is an isometric view of a helical rotary actuator embodying the present invention.

As shown in the drawings for purposes of illustration, the present invention is embodied in a helically splined rotary actuator, indicated generally by reference numeral 10. The actuator 10 includes a body or housing 12 having a cylindrical sidewall 13. The body 12 has a first integral, radially extending, rectangular mounting bracket 14 positioned at a first end 16 of the body and a second integral, radially extending, rectangular mounting bracket 18 positioned at an opposite second end 20 of the body. The brackets 14 and 18 have holes 21 extending therethrough for mounting the actuator 10, with the bracket 18 being mountable to a corresponding bracket 17 of a valve or other device 19 being driven by the actuator. The actuator 10 is designed for use with quarter-turn butterfly, globe and ball valves. A plurality of threaded holes 22 are provided in the outer edge walls of the brackets 14 and 18 for the attachment of accessories.

Rotatably mounted within the body 12 and extending longitudinally from beyond the first end 16 of the body to beyond the second end 20 of the body is a rotary output shaft 24. An end portion 26 of the shaft 24 extends outwardly from the first end 16 of the body 12 and is provided with two opposing flat faces 28 which permit manual turning of the shaft 24 with a wrench or similar tool, and thereby the valve or other device being driven by the actuator 10. An opposite end portion 30 of the shaft 24 extends outwardly from the second end 20 of the body 12 and is provided with a splined recess 32 sized to receive and drivingly engage a rotatable member 34 of an external device 19 which is being driven by rotation of the shaft 24, such as a valve stem.

The actuator 10 has a conventional linear-to-rotary transmission means which includes a ring gear 36 with inner helical splines 38, and a piston sleeve 40 having outer helical splines 42 over a portion of its length which mesh with the helical splines of the ring gear. The piston sleeve 40 is also provided with inner helical splines 44 which mesh with helical splines 46 provided on a splined intermediate portion 48 of the output shaft 24 located toward the second end 20 of the body 12. It should be understood that while helical splines are shown in the drawings and described herein, the principle of the invention is equally applicable to any form of linear-to-rotary motion conversion means.

In the preferred embodiment illustrated, the actuator 10 has a two-piece piston 50 formed by a head portion 52 of the piston sleeve 40 and a piston ring 54 which extends about the head portion and is threadably attached thereto. A set screw 55 maintains the relative positioning of the piston ring 54 on the head portion 52. A seal 56 disposed between the head portion 52 and the piston ring 54 provides a fluid-tight connection therebetween. The piston is slidably maintained within the body 12 for reciprocal movement, and undergoes longitudinal and rotational movement relative to an interior wall surface 58 of the body sidewall 13, as will be described in more detail below. A pair of spaced-apart seals 60 are disposed about a circumferential wall 62 of the piston 50 and between the piston and the interior wall surface 58 of the body 12 to provide a fluid-tight seal therebetween.

The ring gear 36 is joined to the body 12 by a plurality of pins 64 which are uniformly positioned about and extend through a plurality of ring gear fastening holes 66 in the sidewall 13. The pins 64 each have a head 68 which is welded to the body 12. The ring gear 36 may be locked stationary in the position shown in the drawings or may be provided with circumferential slots which loosely receive the pins 64 to allow the ring gear to float about the pins.

As will be readily understood, reciprocation of the piston 50 occurs when hydraulic fluid or air under pressure enters through a first port 70 to one side of the piston or through a second port 72 to the other side of the piston. As the piston 50, and the piston sleeve 40 forming a part thereof, linearly reciprocate in an axial direction within the body 12, the outer helical splines 42 of the piston sleeve engage or mesh with the inner helical splines 38 of the ring gear 36 to cause rotation of the piston sleeve. The linear and rotational movement of the piston sleeve 40 is transmitted through the inner helical splines 44 of the piston sleeve to the outer helical splines 46 of the intermediate portion 48 of the shaft 24 to cause the shaft to rotate. As will be described below, the longitudinal movement of the shaft 24 is restricted, thereby converting all movement of the piston sleeve 40 to rotational movement of the shaft 24. Depending on the slope and direction of turn of the various helical splines, there may be provided a multiplication of the rotary output of the shaft 24.

In accordance with the invention, the actuator 10 has an adjustable first end cap 74 positioned at the first end 16 of the body 12 to provide one precise axially adjustable end limit to the linear movement of the piston 50 within the body 12, and an axially adjustable stop 76 positioned to a side of the piston remote from the first end cap to provide another precise adjustable end limit to the linear movement of the piston, to confine the axial movement of the piston therebetween and thereby confine the end rotation of the output shaft 24 between precise preselected and adjustable end rotational limits. As will be described below, the first end cap 74 and the stop 76 are adjustable from the first end 16 of the body 12 and do not require disconnection of the actuator 10 from the valve or other device 19 to which it is connected to accomplish an adjustment.

The actuator 10 also has a second end cap 78 positioned at the second end 18 of the body 12. The second end cap 78 is provided with a circumferentially extending, inwardly opening retainer channel 80 sized to receive an outwardly extending radial flange 82 of the shaft 24 to permit rotation of the shaft but inhibit its axial movement.

The first end cap 74 has outer threads which engage corresponding inner threads formed along the interior wall surface 58 at the first end 16 of the body 12 to permit adjustment of the first end cap. A plurality of holes 84 are provided in an outwardly facing radial surface 86 of the first end cap 74. The holes 84 are sized and positioned to receive a spanner wrench (not shown) for rotating the cap and thereby effecting axially adjustment of its position. A lock screw 88 extends through the sidewall 13 of the body 12 and is externally adjustable to engage with the first end cap 74 and lock it in place. The first end cap 74 is provided with an inwardly facing radial surface 90 which serves as an engagement stop to limit the axial movement of the piston 50 toward the first end 16 of the body 12.

The stop 76 includes an elongated stop support sleeve 92 with an interior opening 94 sized to receive the shaft 24. A stop shoulder 96 extends radially outward from the sleeve to engage an inwardly facing radial surface 98 of the piston sleeve 40 and thereby limit the axial travel of the piston 50 toward the second end 20 of the body 12. A wall portion 100 along the interior opening 94 of the stop support sleeve 92 has inner threads which engage corresponding outer threads formed along an intermediate portion 101 of the shaft 24, adjacent to the splined intermediate shaft portion 48, to permit axial adjustment of the stop support sleeve relative to the shaft, and thus the axial position of the stop shoulder 96. The stop support sleeve 92 extends past the first end cap 74 and has an end portion 102 externally accessible from the first end 16 of the actuator 10 without removing the first end cap. The end portion 102 of the stop support sleeve 92 is provided with two opposing flat faces 104 which permit manual turning of the sleeve with a wrench or similar tool to adjust the axial position of the stop shoulder 96. A lock screw 105 extends through the end portion 102 of the stop support sleeve 92 and is externally adjustable to engage the shaft 24 and lock the stop support sleeve and shaft together.

A seal 106 is disposed between the shaft 24 and the stop support sleeve 92, and a pair of spaced seals 108 are disposed between the stop support sleeve and the head portion 52 of the piston sleeve 40 to provide fluid-tight seals between the shaft and the stop support sleeve, and between the stop support sleeve and the head portion. Another seal 110 is disposed between the support stop sleeve 92 and the first end cap 74, and a seal 112 is disposed between the first end cap and the interior wall surface 58 of the body 12, to prevent fluid leaks. Thus, a fluid-tight, annular cavity is provided in communication with the port 70 defined by the first end cap 74, the piston 50, the stop support sleeve 92, and the interior wall surface 58 of the body 12. An antifriction bearing 114 is disposed between the stop support sleeve 92 and the first end cap 74 inward of the seal 110.

The second end cap 78 has outer threads which engage corresponding inner threads formed along the interior wall surface 58 at the second end 20 of the body 12. A plurality of holes 116 are provided in an outwardly facing radial surface 118 of the second end cap 78, and are sized and positioned to receive a spanner wrench (not shown) for rotation of the cap. A set screw 120 maintains the positioning of the second end cap 78 relative to the body 12. A pair of antifriction bearings 122 are provided between the flange 82 and a pair of oppositely facing radial walls 123 defining the retainer channel 80. One of the radial walls 123 of the retainer channel 80 is formed by an inner sleeve 124 threadedly attached to a main body portion 126 of the second end cap 78. The inner sleeve 124 permits adjustment of the bearing pressure against the flange 82.

The second end cap 78 has a central opening 128 through which the end portion 30 of the shaft 24 extends. A seal 130 is disposed between the end portion 30 of the shaft 24 and the second end cap 78, and another seal 132 is disposed between the second end cap and the interior wall surface 58 of the body 12 to prevent the loss of fluid from the interior of the body. Thus, a fluid-tight, annular cavity in communication with the port 72 is provided, defined by the second end cap 78, the piston 50, the shaft 24 and the interior wall surface 58.

At the first end 16 of the body 12, a removable cover 134 is provided with a central opening 136 through which the end portion 26 of the shaft 24 extends. A seal is disposed between the end portion 26 of the shaft 24 and the cover 134 to prevent the entry of moisture or dirt. The cover 134 is held in place by a bracket 136 which extends around the perimeter of the cap. The bracket 136 is attached to the mounting bracket 14 by a plurality of bolts 138. While the cover 134 discourages unauthorized adjustments of the first end cap 74 and the stop shoulder sleeve 92, it may still be removed with relative ease to make authorized adjustments to the end rotational limits of the rotational travel of the shaft 24 from one end of the actuator 10 without disconnecting the actuator from the device being driven. Further, the stop mechanism provided is simple to adjust and is protected from the environment in which the actuator 10 is used. The positive engagement of the stops with the piston 50 provides a means for accurately limiting its linear travel within a preselected range, and thus, the rotational travel of the shaft 24.

It will be appreciated that, although a specific embodiment of the invention has been described herein for purposes of illustration, various modifications may be made without departing from the spirit and scope of the invention. Accordingly, the invention is not limited except as by the appended claims.

I claim:

1. A fluid-powered, splined rotary actuator for providing precise, adjustable, end-limited rotational drive to another device, such as a valve through a rotatable valve stem, comprising:

an outer, elongated, cylindrical body having ports for introducing pressurized fluid therein;

a splined output shaft rotatably supported within said body and having at least one drive end adapted for coupling to said other device to provide rotational drive thereto, said shaft drive end being positioned toward a drive end of said body;

a linear-to-rotary transmission means disposed within said body and operable to provide relative rotational movement between said body and said output shaft, said transmission means including a splined piston sleeve having a piston head for application of fluid pressure to a first side of said head to produce linear movement of said piston sleeve in a first direction, and for application of fluid pressure to an opposite second side of said head to produce linear movement of said piston sleeve in an opposite second direction, and a splined ring gear joined to said body, said ring gear splines meshing with said piston sleeve splines and said piston sleeve splines meshing with said shaft splines to translate linear movement of said piston sleeve into rotational movement of said shaft;

an adjustable, threaded end cap disposed within said body at an end of said body remote from said drive end, said end cap threads cooperating with corresponding threads of said body to permit selective longitudinal positioning of said end cap relative to said body, said end cap having a stop surface for engaging said second side of said piston head as it travels in said first direction and limiting linear travel of said piston sleeve in said first direction to provide an end limit to rotational movement of said shaft in a first rotational direction, said first stop being adjustable from said remote end; and an adjustable, elongated stop sleeve positioned about said shaft for rotational movement therewith, said stop sleeve extending from a position outward of said end cap at said remote body end to a position beyond said piston head, and having a stop shoulder for engaging said first side of said piston head as it travels in said second direction and limiting linear travel of said piston sleeve in said second direction to provide an end limit to rotational movement of said shaft in a second rotational direction, said stop sleeve being threaded for cooperation with corresponding threads of said shaft to permit selective longitudinal positioning of said stop shoulder relative to said shaft, said stop shoulder being adjustably positioned by rotation of said stop sleeve from said remote end.

2. A fluid-powered, splined rotary actuator for providing end-limited rotational drive to another device, comprising:

an outer elongated body having ports for introducing pressurized fluid therein;

a splined output shaft rotatably supported within said body and having at least one drive end adapted for coupling to said other device to provide rotational drive thereto, said shaft drive end being positioned toward a drive end of said body;

a linear-to-rotary transmission means disposed within said body and operable to provide relative rotational movement between said body and said output shaft, said transmission means including a splined piston sleeve having a piston head for application of fluid pressure to a first side of said head to produce linear movement of said piston sleeve in a first direction, and for application of fluid pressure to an opposite second side of said head to produce linear movement of said piston sleeve in an opposite second direction, and a splined ring gear joined to said body, said ring gear splines meshing with said piston sleeve splines and said piston sleeve splines meshing with said shaft splines to translate linear movement of said piston sleeve into rotational movement of said shaft;

a first adjustable stop positioned within said body for limiting linear travel of said piston sleeve to said first direction to provide an end limit to rotational movement of said shaft in a first rotational direction, said first stop being adjustable from an end of said body remote from said drive end, said first stop being a threaded end cap disposed within said body at said remote end and cooperating with corresponding threads of said body to permit selective longitudinal positioning of said end cap relative to said body, said end cap having a stop surface for engaging said second side of said piston head as it travels in said first direction; and a second adjustable stop positioned within said body for limiting linear travel of said piston sleeve in said second direction to provide an end limit to rotational movement of said shaft in a second rotational direction, said second stop being adjustable from said remote end of said body.

3. The rotary actuator of claim 2, further including locking means for selectively and releasably locking said end cap to said body.

4. A fluid-powered, splined rotary actuator for providing end-limited rotational drive to another device, comprising:

an outer elongated body having ports for introducing pressurized fluid therein;

a splined output shaft rotatably supported within said body and having at least one drive end adapted for coupling to said other device to provide rotational drive thereto, said shaft drive end being positioned toward a drive end of said body;

a linear-to-rotary transmission means disposed within said body and operable to provide relative rotational movement between said body and said output shaft, said transmission means including a splined piston sleeve having a piston head for application of fluid pressure to a first side of said head to produce linear movement of said piston sleeve in a first direction, and for application of fluid pressure to an opposite second side of said head to produce linear movement of said piston sleeve in an opposite second direction, and a splined ring gear joined to said body, said ring gear splines meshing with said piston sleeve splines and said piston sleeve splines meshing with said shaft splines to translate linear movement of said piston sleeve into rotational movement of said shaft;

a first adjustable stop positioned within said body for limiting linear travel of said piston sleeve in said first direction to provide an end limit to rotational movemennt of said shaft in a first rotational direction, said first stop being adjustable from an end of said body remote from said drive end; and a second adjustable stop positioned within said body for limiting linear travel of said piston sleeve in said second direction to provide an end limit to rotational movement of said shaft in a second rotational direction, said second stop being adjustable from said remote end of said body, said second step being an elongated stop sleeve positioned about said shaft for rotational movement therewith, said stop sleeve extending from said remote body end and beyond said piston head, and having a stop shoulder for engaging said first side of said piston head as it travels in said second direction, said stop sleeve being threaded for cooperation with corresponding threads of said shaft to permit selective longitudinal positioning of said stop shoulder relative to said shaft, said stop shoulder being adjustably positioned by rotation of said stop sleeve from said remote end.

5. The rotary actuator of claim 4, further including locking means for selectively and releasably locking said stop sleeve to said shaft for rotational movement therewith.

6. The rotary actuator of claim 4 wherein said stop sleeve extends beyond said first stop at said remote end and is maintained in a chamber defined by said first stop and an end cover sealing said remote end of said body.

7. A fluid-powered rotary valve actuator for rotating the stem of a valve between precise preselected and adjustable end limits, comprising:

an outer, elongated, cylindrical body having ports for introducing pressurized fluid therein;

an output shaft rotatably supported within said body and having at least one drive end adapted for coupling to another device to provide rotational drive thereto, said shaft drive end being positioned toward a drive end of said body;

a linear-to rotary transmission means coaxial with said output shaft and disposed within said body and operable to provide relative rotational movement between said body and said output shaft, said transmission means including a piston for application of fluid pressure to a first side of said piston to produce linear movement of said piston in a first direction, and for application of fluid pressure to an opposite second side of said piston to produce linear movement of said piston in an opposite second direction, and means for translating linear movement of said piston into rotational movement of said shaft relative to said body;

a first adjustable stop means for limiting linear travel of said piston in said first direction to provide an end limit to rotational movement of said shaft in a first rotational direction, said first stop means being adjustable from an end of said body remote from said drive end, said first stop means including a threaded end cap disposed within said body at said remote end and cooperating with corresponding threads of said body to permit selective longitudinal positioning of said end cap relative to said body, said end cap having a stop surface for engaging said second side of said piston as its travels in said first direction; and a second adjustable stop means for limiting linear travel of said piston in said second direction to provide an end limit to rotational movement of said shaft in a second rotational direction, said second stop means being adjustable from said remote end of said body, whereby adjustment of said first and second stop means provides precise and preselected end limits to the rotation of the valve stem by the actuator.

8. A fluid-powered rotary valve actuator for rotating the stem of a valve between precise preselected and adjustable end limits, comprising:

an outer, elongated, cylindrical body having ports for introducing pressurized fluid therein;

an output shaft rotatably supported within said body and having at least one drive end adapted for coupling to another device to provide rotational drive thereto, said shaft drive end being positioned toward a drive end of said body;

a linear-to-rotary transmission means coaxial with said output shaft and disposed within said body and operable to provide relative rotational movement between said body and said output shaft, said transmission means including a piston for application of fluid pressure to a first side of said piston to produce linear movement of said piston in a first direction, and for application of fluid pressure to an opposite second side of said piston to produce linear movement of said piston in an opposite second direction, and means for translating linear movement of said piston into rotational movement of said shaft relative to said body;

a first adjustable stop means for limiting linear travel of said piston in said first direction to provide an end limit to rotational movement of said shaft in a first rotational direction, said first stop means being adjustable from an end of said body remote from said drive end; and a second adjustable stop means for limiting linear travel of said piston in said second direction to provide an endlimit to rotational movement of said shaft in a second rotational direction, said second stop means being adjustable from said remote end of said body, said second stop means including an elongated stop member, said piston and having a stop positioned on said first side of said piston for engaging said first side as said piston travels in said second direction, said stop member having means for selective longitudinal positioning of said stop relative to said piston from said remote end, whereby adjustment of said first and second stop means provides precise and preselected end limits to the rotation of the valve stem by the actuator.

9. The rotary actuator of claim 8 wherein said stop member is an elongated stop sleeve positioned about said shaft for rotational movement therewith and extending from said remote body end and beyond said piston, said stop is a stop shoulder, and said positioning means includes threads positioned on said stop sleeve for cooperation with corresponding threads of said shaft to permit selective longitudinal positioning of said stop shoulder relative to said shaft and said piston by rotation of said stop sleeve from said remote end.

10. The rotary actuator of claim 9 wherein said positioning means further includes a portion of said stop sleeve accessible from said remote end which is engageable with a tool for rotation of said stop sleeve.

* * * * *